US010377393B2

(12) United States Patent
Zhang et al.

(10) Patent No.: US 10,377,393 B2
(45) Date of Patent: Aug. 13, 2019

(54) HIGH-SPEED RAIL TRAIN BOGIE AND FRAME THEREOF

(71) Applicant: CRRC QINGDAO SIFANG CO., LTD., Qingdao, Shandong (CN)

(72) Inventors: Zhenxian Zhang, Shandong (CN); Xiaoyan Li, Shandong (CN); Pingyu Zhou, Shandong (CN); Xiaowen Song, Shandong (CN); Xiaoming Wang, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 278 days.

(21) Appl. No.: 15/502,688

(22) PCT Filed: Nov. 16, 2015

(86) PCT No.: PCT/CN2015/094664
§ 371 (c)(1),
(2) Date: Feb. 8, 2017

(87) PCT Pub. No.: WO2016/124030
PCT Pub. Date: Aug. 11, 2016

(65) Prior Publication Data

US 2017/0232979 A1 Aug. 17, 2017

(30) Foreign Application Priority Data

Feb. 5, 2015 (CN) ..... 2015 1 0060689
Feb. 5, 2015 (CN) ..... 2015 2 0082416 U

(51) Int. Cl.
*B61F 5/52* (2006.01)
*B61F 5/10* (2006.01)
(Continued)

(52) U.S. Cl.
CPC ..... *B61F 5/52* (2013.01); *B61F 1/12* (2013.01); *B61F 5/10* (2013.01); *B61F 5/245* (2013.01)

(58) Field of Classification Search
CPC .... B61F 1/12; B61F 5/10; B61F 5/245; B61F 5/52; B61F 3/00; B61F 5/144; B61F 5/24
See application file for complete search history.

(56) References Cited

U.S. PATENT DOCUMENTS

2014/0137765 A1* 5/2014 Nishimura ..... B61F 5/52 105/182.1

FOREIGN PATENT DOCUMENTS

CN 103496380 A 1/2014
CN 203543999 U 4/2014
(Continued)

OTHER PUBLICATIONS

JP 4356540—English translation (Year: 2009).*
(Continued)

*Primary Examiner* — Mark T Le
(74) *Attorney, Agent, or Firm* — Yue (Robert) Xu; Apex Attorneys at Law, LLP

(57) ABSTRACT

A high-speed rail train bogie frame includes side sills and cross beams located between the side sills, and each of the side sills is provided with an air spring seat configured to install an air spring; wherein each of the cross beams has a seamless steel tube structure; the frame further includes a passage, and a main air chamber of the air spring and a cavity of the cross beam are in communication with each other through the passage; and an anti-roll bar seat configured to install an anti-roll bar is welded below the side sill, and the anti-roll bar seat is in a circular arc transition with a bottom of the side sill, to form a dovetail structure.

11 Claims, 5 Drawing Sheets

(51) Int. Cl.
*B61F 1/12* (2006.01)
*B61F 5/24* (2006.01)

(56) References Cited

FOREIGN PATENT DOCUMENTS

| | | | |
|---|---|---|---|
| CN | 203612008 | U | 5/2014 |
| CN | 203666683 | U | 6/2014 |
| CN | 104118448 | A | 10/2014 |
| CN | 203958162 | U | 11/2014 |
| CN | 104648432 | A | 5/2015 |
| CN | 204415418 | U | 6/2015 |
| JP | H0350066 | A | 3/1991 |
| JP | 4356540 | B2 | 11/2009 |
| JP | 2013203321 | A | 10/2013 |

OTHER PUBLICATIONS

CN 203666683—English translation (Year: 2014).*
CN 104118448 (Year: 2014).*
International Search Report for PCT/CN2015/094664, dated Feb. 29, 2016, ISA/CN.

* cited by examiner

HIGH-SPEED RAIL TRAIN BOGIE AND FRAME THEREOF

This application is the national phase of International Application No. PCT/CN2015/094664, titled "HIGH-SPEED RAIL TRAIN BOGIE AND FRAME THEREOF", filed on Nov. 16, 2015, which claims the benefit of priorities to Chinese patent application No. 201510060689.1 titled "BOGIE FOR HIGH-SPEED RAILWAY TRAIN AND FRAME THEREOF", filed with the Chinese State Intellectual Property Office on Feb. 5, 2015, and Chinese patent application No. 201520082416.2 titled "BOGIE FOR HIGH-SPEED RAILWAY TRAIN AND FRAME THEREOF", filed with the Chinese State Intellectual Property Office on Feb. 5, 2015, the entire disclosures of which are incorporated herein by reference.

FIELD

The present application relates to the technical field of railway vehicles, in particular to a bogie for a high-speed railway train and a frame thereof.

BACKGROUND

At present, high-speed railways and urban railway vehicles develop fast in China, and the requirements of comfort and safety for the vehicles become increasingly high. Because an air spring has an adjustable rigidity and a relatively constant low natural frequency of vibration, which can increase the ride comfort of a car, thus the air spring is widely used in a suspension device.

When a bogie of a railway train is equipped with an air spring having a low vertical rigidity, a vertical dynamics performance of the train is improved, and meanwhile, the anti-roll rigidity of the train is also decreased. When the train passes a curve, an excessive low anti-roll rigidity may cause an angle of roll of a train body to increase, and may cause the contours of the train body to exceed a gauge in a serious case, and may even threaten an overturning safety of the train. Therefore, a bogie using the air spring suspension is required to increase the anti-roll rigidity of the train, to restrict a rolling angular displacement of the train body. Installing an anti-roll device can effectively increase the anti-roll rigidity of the train and the structure is easy. Therefore, an anti-roll bar is generally used domestic and overseas, and using the anti-roll bar is an effective method.

However, there are many components on the bogie and the installation positions thereof are limited, thus the installation space for the air spring is small, which limits the damping effect of the air spring. In view of this technical problem, the solution generally used is to provide an auxiliary air chamber for the air spring on the frame, to increase the volume of the air chamber and effectively decrease the rigidity of the air spring and increase a damping thereof, thereby increasing a damping effect of the air spring.

According to the current mainstream opinion, the above problem can be solved by using a cavity of a side sill of the frame as the auxiliary air chamber of the air spring.

A structure of a typical frame of a railway train bogie is shown in FIGS. 1 to 3. FIG. 1 is a schematic view showing the typical frame of the railway train bogie, FIG. 2 is a view of FIG. 1 viewed in direction A, and FIG. 3 is a sectional view of FIG. 1.

As shown in FIGS. 1 to 3, the frame includes two side sills 1' arranged at two sides of the frame and two cross beams 2' arranged at the middle of the frame, two ends of each of the cross beams 2' pass through the side sills 1' and are fixed to the side sills 1' by welding, and each of the side sills 1' is provided with an air spring seat 3' configured to install the air spring. The side sill 1' has a box-shaped structure formed by jointing and welding steel plates, and an anti-roll bar seat 4' is fixedly arranged on an inner side of the side sill 1'. A sealed auxiliary air chamber 6' is partitioned off in an inner cavity of the side sill 1' by two blocking plates 5', and the auxiliary air chamber 6' is in communication with the air spring via an air hole 7'.

The above frame structure has the following technical problems.

First, the auxiliary air chamber of the bogie frame can meet the damping requirement of a low-speed or middle-speed train, however, as the running speed of the train increases, a loading condition of a high-speed railway train (the speed can reach 500 km/h) becomes more complicated, the performance of the air spring of the bogie decreases, and a damping effect at a higher speed can not realized well.

Secondly, the conventional connection structure between the anti-roll bar seat and the frame is complicated and is not good for realizing a light weight.

In view of the defects existing in the above frame structure, the technical problem to be solved by the present application is to provide a bogie frame meeting the damping requirement of the high-speed railway train.

SUMMARY

For solving the above technical problems, a first object of the present application is to provide a frame of a bogie of a high-speed railway train. When the frame is used on the high-speed railway train, it can not only realize a damping effect of an air spring but also can obtain a good damping effect when the train is at a high speed. On this basis, a bogie of a train having the frame is further provided according to the present application.

A frame of a bogie of a high-speed railway train is provided according to the present application and includes side sills and cross beams located between the side sills, and each of the side sills is provided with an air spring seat configured to install an air spring, and a main air chamber of the installed air spring is located in a cavity of the side sill. Each of the cross beams has a seamless steel tube structure, the frame further includes a passage, and the main air chamber of the air spring and the cavity of the cross beam are in communication with each other through the passage.

The main air chamber of the air spring is in communication with the cavity of the cross beam through the passage, and the cavity of the cross beam can function as an auxiliary air chamber of the air spring, thus the communication between the main air chamber of the air spring and the auxiliary air chamber is realized, an inner space of the frame is effectively used, and there is no need to install an independent air cylinder for the air spring. Meanwhile, a volume of the air chamber of the air spring is increased, which decreases a natural vibration frequency of the air spring, thus the air spring can keep a low and almost constant vibration frequency under any loads, thereby realizing a vibration damping function and increasing the comfort of the railway train.

More importantly, as discovered in the experiments, the reason why the damping performance of the air spring decreases in a high speed running environment is that the side sill functioning as the auxiliary air chamber has a poor gas tightness. The side sill is formed by jointing and welding steel plates, and the periphery of the side sill has many welding lines, thus the gas tightness is poor. The present application made an improvement just on this basis, a cavity of a cross beam having a hollow seamless steel tube structure is used as the auxiliary air chamber of the air spring, and there are no welding line at the periphery of the seamless steel tube structure, thus the gas tightness is good. Thus, compared with the conventional technology, the auxiliary air chamber of the air spring according to the present application has a good gas tightness and can meet the damping requirement of the train at the high speed.

Preferably, the frame further includes an air chamber which is arranged longitudinally, two ends of the air chamber are respectively in communication with two of the cross beams, and the passage is in communication with the air chamber, to be in communication with the cavity of each of the cross beams.

Preferably, two ends of the air chamber are respectively fixed on inner side walls of the respective cross beams by welding, the inner side wall of each of the cross beams is provided with a cross beam through hole at a position corresponding to an end portion of the air chamber, and the cross beam through hole is configured to communicate the cavity of the cross beam with the air chamber.

Preferably, the air chamber is of a bending plate structure having a U-shaped section, an open side of the air chamber is longitudinally welded on an inner side wall of the respective side sill; and the respective side sill and the cross beams are connected by the air chamber.

Preferably, a side sill through hole is provided in the inner side wall of the side sill at a position corresponding to the open side of the air chamber; the passage is transversely arranged, and one end of the passage is in communication with the main air chamber of the air spring and another end of the passage extends into the side sill through hole to be in communication with the air chamber.

An anti-roll bar seat configured to install an anti-roll bar is welded below each of the side sills, and the anti-roll bar seat is in a circular arc transition with a bottom of the side sill, to form a dovetail structure.

Preferably, the anti-roll bar seat is of a structure formed by welding steel plates, a top portion of the anti-roll bar seat has an opening and a bottom portion of the anti-roll bar seat is an installation plate, and the installation plate is configured to install the anti-roll bar, and the top portion of the anti-roll bar seat and a lower side wall of the side sill are welded to form a box-shaped structure.

Preferably, the installation plate at the bottom portion of the anti-roll bar seat is formed by profiling steel plates, and the installation plate is provided with bolt holes configured to install the anti-roll bar.

A bogie for a high-speed railway train is further provided by the present application, and the bogie includes a frame, and a wheel set, an axle box, a suspension device and a foundation braking device which are arranged on the frame, and the frame is the above-mentioned frame.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art, other drawings may be obtained based on these drawings without any creative efforts.

Figure 1:
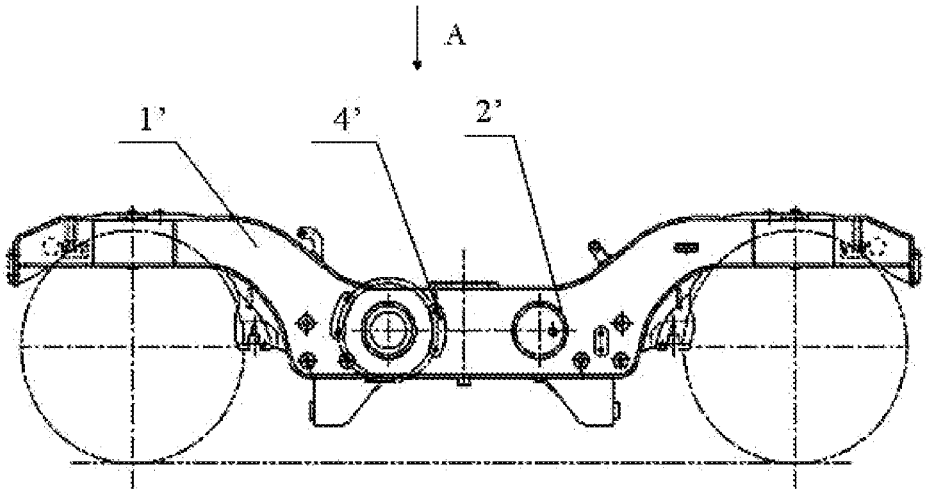
Fig. 1 Prior Art
FIG. 1 is a schematic view showing a frame of a bogie in the conventional technology.
Figure 2:
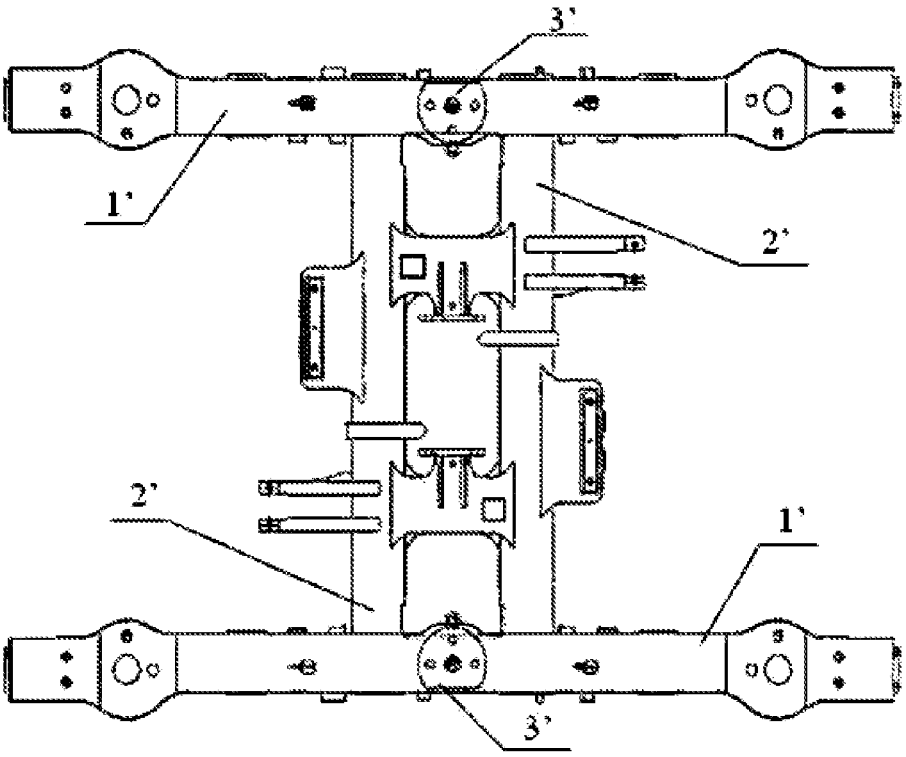
Fig. 2 Prior Art
FIG. 2 is a view of FIG. 1 viewed in direction A.
Figure 3:
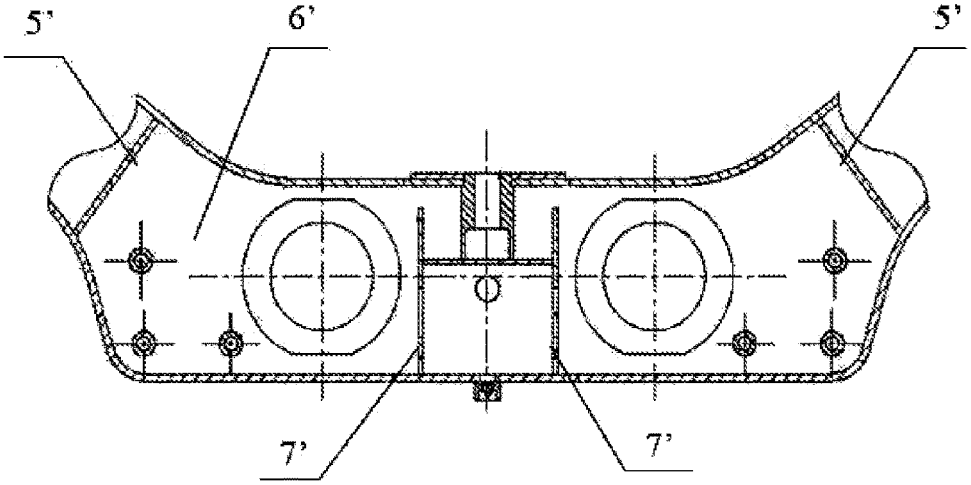
Fig. 3 Prior Art
FIG. 3 is a sectional view of FIG. 1.

| Reference Numerals in FIGS. 1 to 3: | |
|---|---|
| 1' side sill, | 2' cross beam, |
| 3' air spring seat, | 4' anti-roll bar seat, |
| 5' blocking plate, | 6' auxiliary air chamber, |
| 7' air hole. | |
| **Reference Numerals in FIGS. 4 to 9:** | |
| 1 side sill, | 2 cross beam, |
| 3 air chamber, | 4 anti-roll bar seat, |
| 5 air spring, | 6 passage, |
| 7 anti-roll bar, | 11 air spring seat, |
| 12 side sill through hole, | 21 cross beam through hole, |
| 41 dovetail structure, | 42 installation plate, |
| 43 bolt hole, | 51 main air chamber. |

DETAILED DESCRIPTION

For making the objects, technical solutions and advantages of embodiments of the present application clearer, the technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of protection of the present application.

For solving the above technical problems, a core of the present application is to provide a frame of a bogie with a good damping effect at a high speed, and the frame can better realize the damping effect of an air spring at the high speed. Another core of the present application is to provide a train bogie having the frame.

It should be noted that, terms indicating directions and positions, for example "longitudinal direction" and "inward", in the present application are defined according to the structures of components of the frame and the directions and positions of the components after being connected. The "longitudinal direction" refers to a direction perpendicular to a cross beam 2 of the frame, that is, a direction in parallel with a side sill 1 of the frame. The "inward" refers to a direction close to a transverse or longitudinal center line of the frame after the components of the frame are connected to each other. It should be appreciated that the terms indicating directions and positions are defined according to the directions and positions of the components of the frame after they are connected to each other, and should not affect the scope of protection of the present application.

Figure 4:
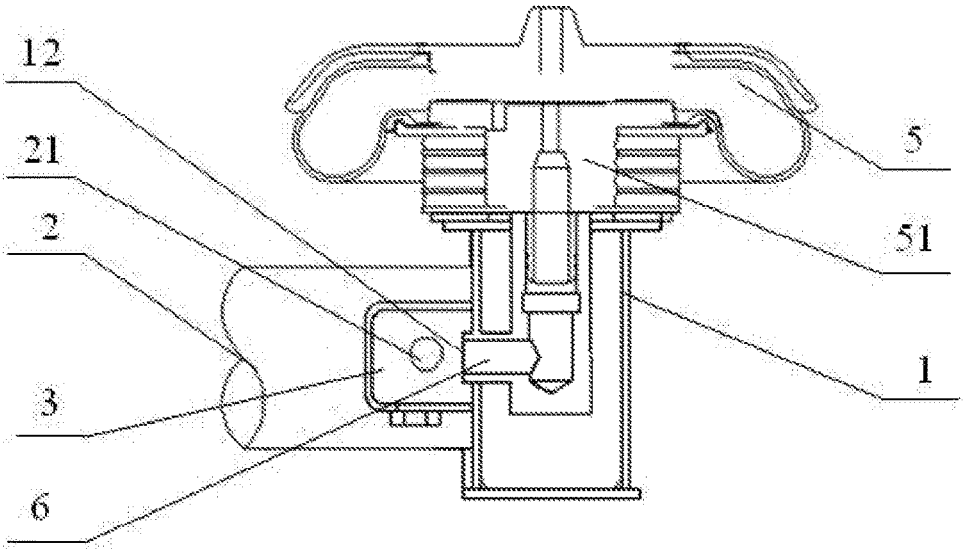
FIG. 4 is a schematic view showing an air chamber connection structure according to the present application.
Figure 5:
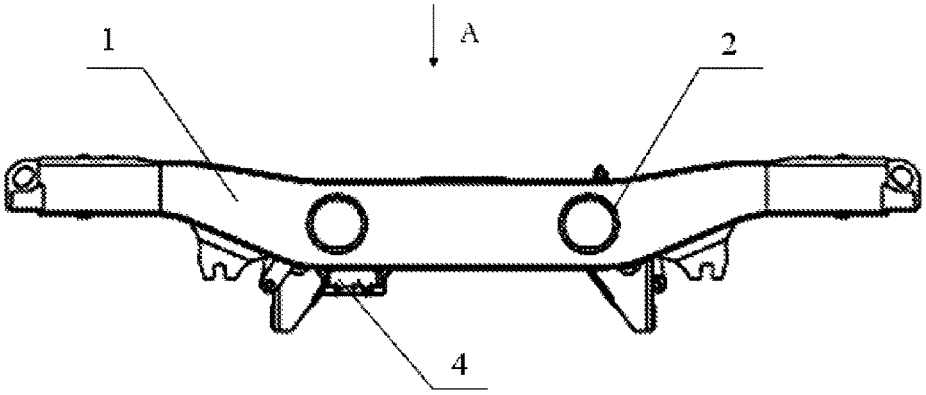
FIG. 5 is a schematic view showing a frame of a bogie according to the present application.
Figure 6:
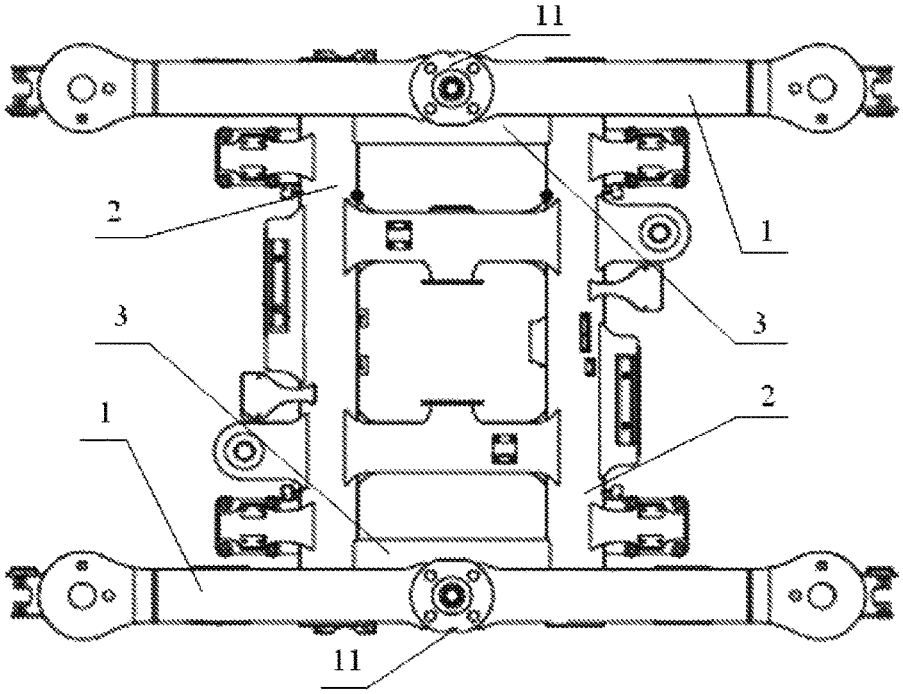
FIG. 6 is a view of FIG. 5 viewed in direction A.

Reference is made to FIGS. 4 to 6. FIG. 4 is a schematic view showing the air chamber connection structure according to the present application, FIG. 5 is a schematic view showing a frame according to an embodiment of the present application, and FIG. 6 is a view of FIG. 5 viewed in direction A.

In a specific embodiment, the frame (as illustrated in FIGS. 4 to 6) according to the present application includes two side sills 1 and two cross beams 2 located between the two side sills 1. Each of the side sills 1 is provided with an air spring seat 11 configured to install an air spring 5, a main air chamber 51 of the installed air spring 5 is located in an inner chamber of the side sill 1, and each of the cross beams 2 has a hollow seamless steel tube structure. Furthermore, as shown in FIG. 4, the frame according to the present application also includes a passage 6 which is configured to communicate the main air chamber 51 of the air spring 5 with a cavity of the cross beam 2.

As shown in FIG. 4, the main air chamber 51 of the air spring 5 is in communication with the cavity of the cross beam 2 through the passage 6, and the cavity of the cross beam 2 can function as an auxiliary air chamber of the air spring 5, thus the communication between the main air chamber 51 of the air spring 5 and the auxiliary air chamber is realized, an inner space of the frame is effectively used, and there is no need to install an independent air cylinder for the air spring 5. Meanwhile, a volume of the air chamber of the air spring 5 is increased, which decreases a natural vibration frequency of the air spring 5, thus the air spring 5 can keep a low and almost constant vibration frequency under any loads, thereby realizing a vibration damping function and increasing the comfort of the railway train.

More importantly, as discovered in the experiments, the reason why the damping performance of the air spring decreases in a high speed running environment is that the side sill functioning as the auxiliary air chamber has a poor gas tightness. The side sill 1' is formed by jointing and welding steel plates, and the periphery of the side sill 1' has many welding lines, thus the gas tightness is poor. The present application made an improvement just on this basis, a cavity of a cross beam 2 having a hollow seamless steel tube structure is used as the auxiliary air chamber of the air spring 5, and there are no welding line at the periphery of the seamless steel tube structure, thus the gas tightness is good. Thus, compared with the conventional technology, the auxiliary air chamber of the air spring 5 according to the present application has a good gas tightness and can meet the damping requirement of the train at the high speed. Moreover, the seamless steel tube can have a circular ring section, thus when it suffers an inner or outer radial pressure, the seamless steel tube is uniformly stressed, which further meets the bearing requirement of the train at the high speed.

In a specific embodiment, as shown in FIGS. 4 to 6, the frame according to the present application further includes an air chamber 3 arranged longitudinally. Two ends of the air chamber 3 are respectively in communication with two side sills 2. Furthermore, the passage 6 communicates the air chamber 3 with the main air chamber 51 of the air spring 5, to realize the communication between the main air chamber 51 of the air spring 5 and the cavity of the cross beam 2.

The air chamber 3 has a hollow inner structure, the communication between the passage 6 and the cavity of the cross beam 2 is conveniently realized by an inner cavity of the air chamber 3, thus the main air chamber 51 of the air spring 5 is in communication with the auxiliary air chamber. On one hand, the air chamber 3 together with the cavity of the cross beam 2 can function as the auxiliary air chamber, which further increases the volume of the auxiliary air chamber of the air spring and increases the damping function of the air spring 5; and on the other hand, the air chamber 3 (as shown in FIG. 6) is longitudinally arranged, which can increase the torsional rigidity of a junction of the side sill 1 and the cross beam 2, and thus increase the strength and the rigidity of the frame.

Furthermore, as shown in FIG. 6, two ends of the air chamber 3 are respectively fixed on inner side walls of the respective cross beams 2 by welding. At the same time, as shown in FIG. 4, the inner side wall of each cross beam 2 is provided with a cross beam through hole 21 at a position corresponding to an end portion of the air chamber 3, and the cavity of the cross beam 2 is in communication with the air chamber 3 through the cross beam through hole 21.

In this embodiment, the air chamber 3 is fixed to the inside walls of the cross beams 2 by welding, the connection manner is easy, and the gas tightness is good, other connection structures can be saved, which realizes a light weight of the frame. Therefore, a preferable connection manner of the air chamber 3 and the inside walls of the cross beams 2 is the welding connection. However, it can be understood by the person skilled in the art that, in theory, the connection manner of the two ends of the air chamber 3 and the inside walls of the two cross beams 2 is not limited to the welding connection, can also be realized in other manners, for example, the two ends of the air chamber 3 can be inserted into inner cavities of the cross beams 2, and portions, where the ends of the air chamber 3 and the cross beams 2 are connected, can be sealed, or, a corresponding connection fastener may also be designed.

On this basis, the air chamber 3 can be embodied as a bending plate structure having a U-shaped section, and an open side of the air chamber 3 is longitudinally welded on an inner side wall of the side sill 1, thereby connecting the side sill 1 with the cross beams 2 by the air chamber 3. In conjunction with FIGS. 4 and 6, it can be understood that, two edges of the open side of the U-shaped bending plate are welded on the cross beams 2, and the passage 6 is at a position corresponding to a position of the open side of the U-shaped bending plate, to communicate with the air chamber 3.

In this embodiment, the air chamber 3 has a U-shaped bending plate structure and cooperates with the inner side wall of the side sill 1 to form a required cavity. On one hand, the inner side wall of the side sill 1 is used, which saves the material for forming the air chamber 3 and realizes a light weight of the frame. More importantly, the welding fixation of the side sills 1 and the cross beams 2 is realized by the air chambers 3, thus the side sills 1 and the cross beams 2 are not required to be directly fixed by welding. If the side sills 1 and the cross beams 2 are directly fixed by welding, according to the installation structure and the space limitation, the welding lines generated by welding is difficult to be seen, and it is inconvenient for the welding and gas tightness detection. If the welding position of the air chamber 3 is not shielded, the welding lines are easy to observe and thus it is convenient for welding and gas tightness detection.

It should be noted that, the main function of the air chamber 3 is communicating the passage 6 with the cavity of the cross beam 2, thus the air chamber 3 can be embodied as any structure having an inner cavity, for example, the section of the air chamber 3 can be triangular or other shapes, or the air chamber 3 may also be a complete cavity structure which is formed by directly welding steel plates. However, compared with the triangular section, the U-shaped section has a great anti-bending section coefficient, a small stress and a high strength. The complete cavity structure directly formed by welding steel plates may generate a plurality of welding lines, thus the gas tightness is poor. The bending plate structure with the U-shaped section has an integrated structure, a good gas tightness, a high torsional rigidity, and a simple structure. Therefore, the air chamber 3 in the present application is preferably to be embodied as the bending plate structure with the U-shaped section.

It can be appreciated that, for realizing the communication between the passage 6 and the air chamber 3, a side sill through hole 12 is required to be provided in the inner side wall of the side sill 1 at a position corresponding to the open side of the air chamber 3. In this case, the passage 6 can be transversely arranged, one end of the passage 6 is in communication with the main air chamber 51 of the air spring 5 and another end of the passage 6 extends into the side sill through hole 12 to communicate with the air chamber 3.

In the above embodiments, the passage 6 and the cavity of the cross beam 2 are in communication with each other by the air chamber 3 which is longitudinally arranged. Besides realizing the communication between the passage 6 and the cavity of the cross beam 2, the longitudinally arranged air chamber 3 also increases the torsional rigidity of the frame. It can be appreciated that, the communication manner between the passage 6 and the cavity of the cross beam 2 is not limited to this. For example, the frame may include two bending tubes, one end of each bending tube is in communication with the passage 6 and another end is in communication with the cavity of the respective cross beam 2. This structure can also realize the communication between the passage 6 and the cavity of the cross beam 2. However, because this structure includes two separately arranged bending tubes, this structure has a poor strength and a poor rigidity when compared with the air chamber 3 having the integrated structure. Therefore, the passage 6 and the cavity of the cross beam 2 are preferably in communication with each other by the air chamber 3.

Figure 7:
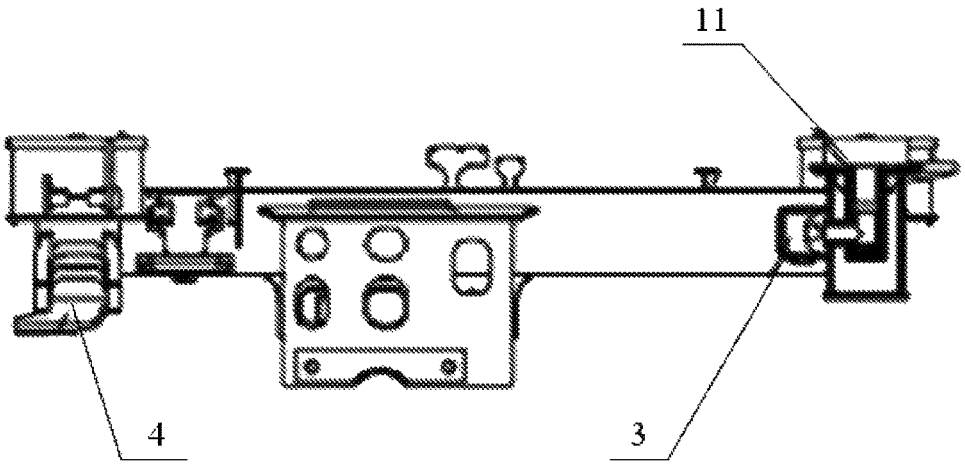
FIG. 7 is a partial lateral sectional view of FIG. 5.
Figure 8:
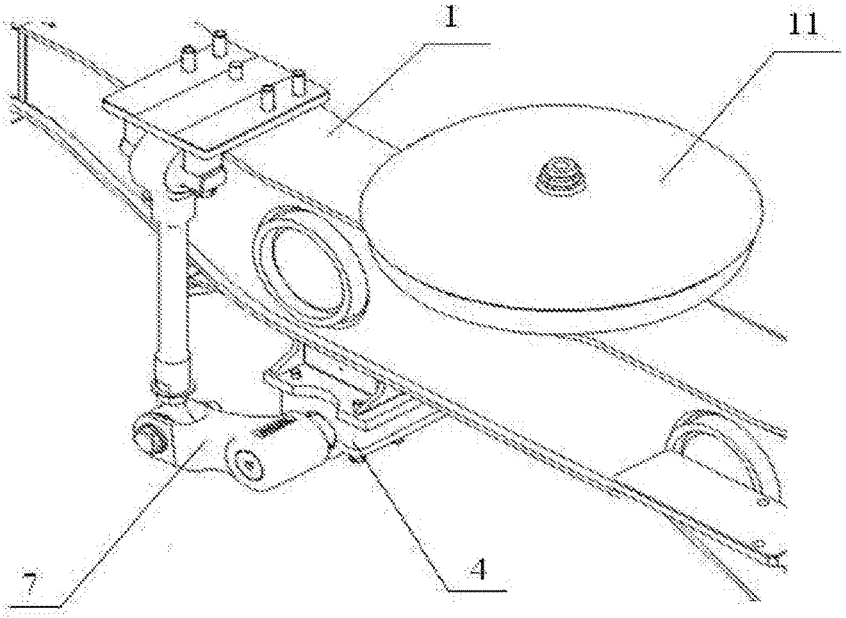
FIG. 8 is a schematic view showing an installation of an anti-roll bar and an anti-roll bar seat.
Figure 9:
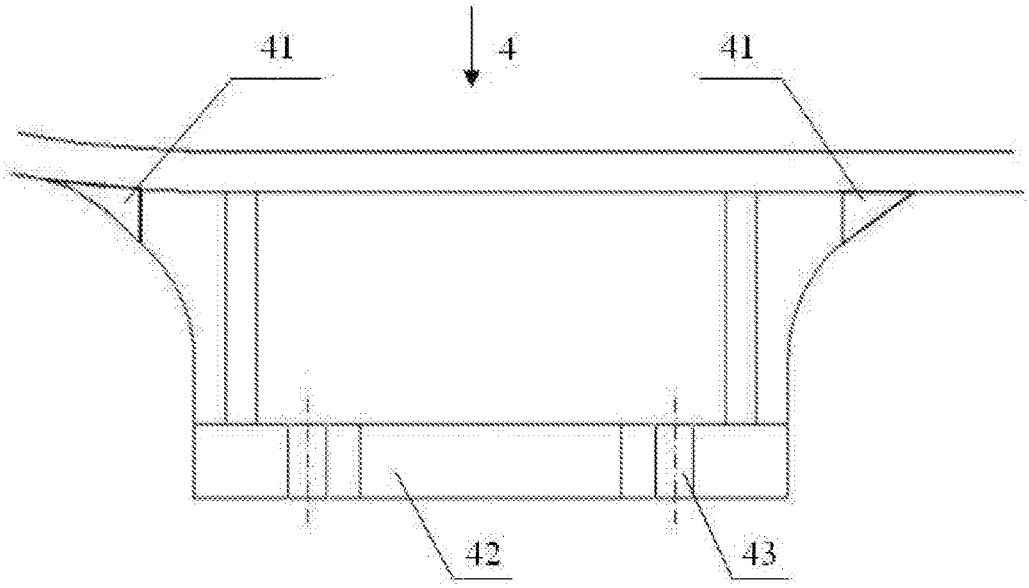
FIG. 9 is a schematic view showing the anti-roll bar seat in FIG. 8.

In view of the above embodiments, further improvements can be made. Referring further to FIGS. 7 to 9, FIG. 7 is a partial lateral sectional view of FIG. 5, FIG. 8 is a schematic view showing an installation of an anti-roll bar and an anti-roll bar seat, and FIG. 9 is a schematic view showing the anti-roll bar seat in FIG. 8.

As shown in FIGS. 7 and 8, an anti-roll bar seat 4 configured to install an anti-roll bar 7 can be welded below the side sill 1, and the anti-roll bar seat 4 is in a circular arc transition with a bottom of the side sill 1, to form a dovetail structure 41.

As shown in FIG. 8, the anti-roll bar seat 4 provided according to the present application is welded below the side sill 1, and in this case, the anti-roll bar 7 is located at an outer side of the side sill 1, and compared with the solution of arranging the anti-roll bar 7 at an inner side of the side sill 1, in this solution, the anti-roll bars 7 arranged at two sides of the side sills 1 have a large transverse span, and under the same reaction torque, the waggling amplitude of the train body is small, which has a better effect for improving the comfort of the train and the anti-roll function.

Furthermore, the inner side of the side sill 1 is provided with the air chamber 3 in the above embodiments, and by arranging the anti-roll bar 7 at the outer side of the side sill 1, an interference between the anti-roll bar 7 and the air chamber 3 can be avoided. On the whole, the arrangement of the anti-roll bar device is compact and the occupied transverse space is the smallest. However, it can be appreciated that, the anti-roll bar seat 4 is not limited to be installed below the side sill 1, and it also can be installed below the cross beam 2, and in this case, the anti-roll bar 7 is located at the inner side of the side sill 1 of the frame.

Meanwhile, as shown in FIG. 9, the anti-roll bar seat 4 is in a circular arc transition with the bottom of the side sill 1, to form the dovetail structure 41, which can effectively alleviate the problem of stress concentration at the position where the side sill 1 and the anti-roll bar seat 4 are connected, and thus increase the strength of the frame. Furthermore, the connection manner between the side sill 1 and the anti-roll bar seat 4 is not limited to welding, the reason is the same as above and will not be described herein.

Specifically, the anti-roll bar seat 4 may be a structure formed by welding the steel plates, a top portion of the structure has an opening and a bottom portion of the structure is an installation plate 42. The installation plate 42 is configured to install the anti-roll bar 7, and a top portion of the anti-roll bar seat 4 may be welded to the side sill 1 to form a box-shaped structure.

As shown in FIGS. 7 and 8, the top portion of the anti-roll bar seat 4 is welded to a bottom wall of the side sill 1 to form a box-shaped structure, which ensures an enough structural strength and rigidity, and an inside of the box-shaped structure provides an installation space for the anti-roll bar 7.

Furthermore, the installation plate 42 at the bottom of the anti-roll bar seat 4 can be formed by profiling the steel plate, and the installation plate 42 is provided with bolt holes 43 for installing the anti-roll bar 7.

As shown in FIGS. 7 and 8, the installation plate 42 at the bottom of the anti-roll bar seat 4 is formed by profiling the steel plate, and a forming method of steel plate profiling has advantages that the weight is light and the strength is high. It can be appreciated that, the forming method for the installation plate 42 is not only limited to the steel plate profiling, and other forming methods, such as casting, can also be used. However, compared with the profiling, the steel plate formed by casting has a lower strength. Therefore, the installation plate 42 preferably uses the forming method of steel plate profiling.

In conclusion, the frame according to the present application employs an integrated frame structure connected by welding. Under the premise of realizing the connection stability and the connection strength, it can effectively simplify the connection structure between the beams and realize a light weight of the frame. The air chamber 3 is welded between the side sill 1 and the cross beam 2, and the air chamber 3 and the cavity of the cross beam 2, which are in communication with each other, function as the auxiliary air chamber of the air spring 5. The whole structure is easy, which facilitates installing the anti-roll bar 7 below the side sill 1. Under the premise of meeting the requirements of the damping and strength, it can increase the anti-roll rigidity of the train and thus meet the requirements of the railway train at the high speed.

A bogie of a high-speed railway train is further provided according to the present application, and the bogie includes a frame, and a wheel set, an axle box, a suspension device and a foundation braking device which are arranged on the frame. The frame is the frame according to any one of the above embodiments. Because the above frame has the above-mentioned technical effects, the bogie having the frame also has the same technical effects, which will not be described herein.

The bogie of the high-speed railway train and the frame thereof provided by the present application are described in detail hereinbefore. The principle and the embodiments of the present application are illustrated herein by specific examples. The above description of examples is only intended to help the understanding of the method and the core concept of the present application. It should be noted that, for the person skilled in the art, several modifications and improvements may be made to the present application without departing from the principle of the present application, and these modifications and improvements are also deemed to fall into the scope of protection of the present application defined by the claims.

What is claimed is:

1. A frame for a bogie of a high-speed railway train, comprising side sills and cross beams located between the side sills, and each of the side sills being provided with an air spring seat configured to install an air spring; wherein each of the cross beams has a seamless steel tube structure; the frame further comprises passages, and a main air chamber of each air spring and a cavity of the respective cross beam are in communication with each other through the respective passage; and an anti-roll bar seat configured to install an anti-roll bar is welded below each side sill, and the anti-roll bar seat is in a circular arc transition with a bottom of the side sill, to form a dovetail structure;

wherein the frame further comprises two air chambers which are arranged longitudinally, two ends of each of the air chambers are respectively in communication with two of the cross beams, and each passage is in communication with the respective air chamber, to be in communication with the cavities of the cross beams; and wherein each of the air chambers is of a bending plate structure having a U-shaped section, an open side of the air chamber is longitudinally welded on an inner side wall of the respective side sill; and the respective side sill and the cross beams are connected by the air chamber.

2. The frame for the bogie of the high-speed railway train according to claim 1, wherein two ends of each of the air chambers are respectively fixed on inner side walls of the respective cross beams by welding, the inner side wall of each of the cross beams is provided with a cross beam through hole at a position corresponding to an end portion of the air chamber, and the cross beam through hole is configured to communicate the cavity of the cross beam with the air chamber.

3. The frame for the bogie of the high-speed railway train according to claim 1, wherein a side sill through hole is provided in the inner side wall of each side sill at a position corresponding to the open side of the respective air chamber; each passage is transversely arranged, and one end of the passage is in communication with the main air chamber of the respective air spring and another end of the passage extends into the respective side sill through hole to be in communication with the respective air chamber.

4. The frame for the bogie of the high-speed railway train according to claim 3, wherein the anti-roll bar seat is of a structure formed by welding steel plates, a top portion of the anti-roll bar seat has an opening and a bottom portion of the anti-roll bar seat is an installation plate, and the installation plate is configured to install the anti-roll bar, and the top portion of the anti-roll bar seat and a lower side wall of the side sill are welded to form a box-shaped structure.

5. The frame for the bogie of the high-speed railway train according to claim 4, wherein the installation plate at the bottom portion of the anti-roll bar seat is formed by profiling steel plates, and the installation plate is provided with bolt holes configured to install the anti-roll bar.

6. A bogie for a high-speed railway train, comprising a frame, and a wheel set, an axle box, and a suspension device which are arranged on the frame, wherein the frame is the frame for the bogie of the high-speed railway train according to claim 1.

7. The frame for the bogie of the high-speed railway train according to claim 2, wherein a side sill through hole is provided in the inner side wall of each side sill at a position corresponding to the open side of the respective air chamber; each passage is transversely arranged, and one end of the passage is in communication with the main air chamber of the respective air spring and another end of the passage extends into the respective side sill through hole to be in communication with the respective air chamber.

8. The frame for the bogie of the high-speed railway train according to claim 7, wherein the anti-roll bar seat is of a structure formed by welding steel plates, a top portion of the anti-roll bar seat has an opening and a bottom portion of the anti-roll bar seat is an installation plate, and the installation plate is configured to install the anti-roll bar, and the top portion of the anti-roll bar seat and a lower side wall of the side sill are welded to form a box-shaped structure.

9. The frame for the bogie of the high-speed railway train according to claim 8, wherein the installation plate at the bottom portion of the anti-roll bar seat is formed by profiling steel plates, and the installation plate is provided with bolt holes configured to install the anti-roll bar.

10. The bogie for a high-speed railway train according to claim 6, wherein two ends of each of the air chambers are respectively fixed on inner side walls of the respective cross beams by welding, the inner side wall of each of the cross beams is provided with a cross beam through hole at a position corresponding to an end portion of the air chamber, and the cross beam through hole is configured to communicate the cavity of the cross beam with the air chamber.

11. The bogie for a high-speed railway train according to claim 6, wherein a side sill through hole is provided in the inner side wall of each side sill at a position corresponding to the open side of the respective air chamber; each passage is transversely arranged, and one end of the passage is in communication with the main air chamber of the respective air spring and another end of the passage extends into the respective side sill through hole to be in communication with the respective air chamber.

* * * * *